US006236624B1

(12) United States Patent
Kriesel et al.

(10) Patent No.: US 6,236,624 B1
(45) Date of Patent: May 22, 2001

(54) TIMING DEVICE

(75) Inventors: Marshall S. Kriesel, Saint Paul, MN (US); William W. Feng, Lafayette, CA (US); Farhad Kazemzadeh, Bloomington, MN (US)

(73) Assignee: Science Incorporated, Bloomington, MN (US)

( * ) Notice: Subject to any disclaimer, the term of this patent is extended or adjusted under 35 U.S.C. 154(b) by 0 days.

(21) Appl. No.: 09/316,767

(22) Filed: May 21, 1999

(51) Int. Cl.[7] ..... G09F 1/00
(52) U.S. Cl. ..... 368/65; 89/97; 89/1
(58) Field of Search ..... 368/1, 10, 97, 368/87, 65, 89, 327

(56) References Cited

U.S. PATENT DOCUMENTS

| | | | |
|---|---|---|---|
| 2,770,941 | 11/1956 | Flagiello . | |
| 3,171,245 | 3/1965 | Breed . | |
| 3,353,412 | 11/1967 | Humphrey . | |
| 3,550,458 | 12/1970 | Dunlop . | |
| 3,563,023 | 2/1971 | Breed . | |
| 3,563,024 | 2/1971 | Breed . | |
| 3,603,072 | 9/1971 | Breed . | |
| 3,731,021 | 5/1973 | Barnard . | |
| 3,844,311 | 10/1974 | McSwain . | |
| 3,933,337 | 1/1976 | Morris et al. . | |
| 4,315,327 | 2/1982 | Bremer . | |
| 4,436,434 | 3/1984 | Stoll et al. . | |
| 4,447,161 | 5/1984 | Stoll et al. . | |
| 4,569,369 | 2/1986 | Rinkewich . | |
| 5,343,444 * | 8/1994 | agut sanz | 368/97 |
| 5,445,182 | 8/1995 | Sturman et al. . | |

* cited by examiner

*Primary Examiner*—Bernard Roskoski
(74) *Attorney, Agent, or Firm*—James E. Brunton

(57) ABSTRACT

A fluid operated timing device in which the timing interval is determined by the rate at which the fluid flows through a precisely configured rate control frit upon being forced through the frit by an energy source in the form of a compressible elastomeric member.

16 Claims, 6 Drawing Sheets

62
63
60
30
32
14
16
18
33
41
26
20
44
28
50
46
24
56
52
42
17
16a
17a
38
26b
40
22
22a
18a
33

62
63
60
30
32
14
16
F
41
26
24
22a
18
20
35
28
50
46
56
52
35
24
17
16a
17a
38
42
40
22
18a

FIG.3
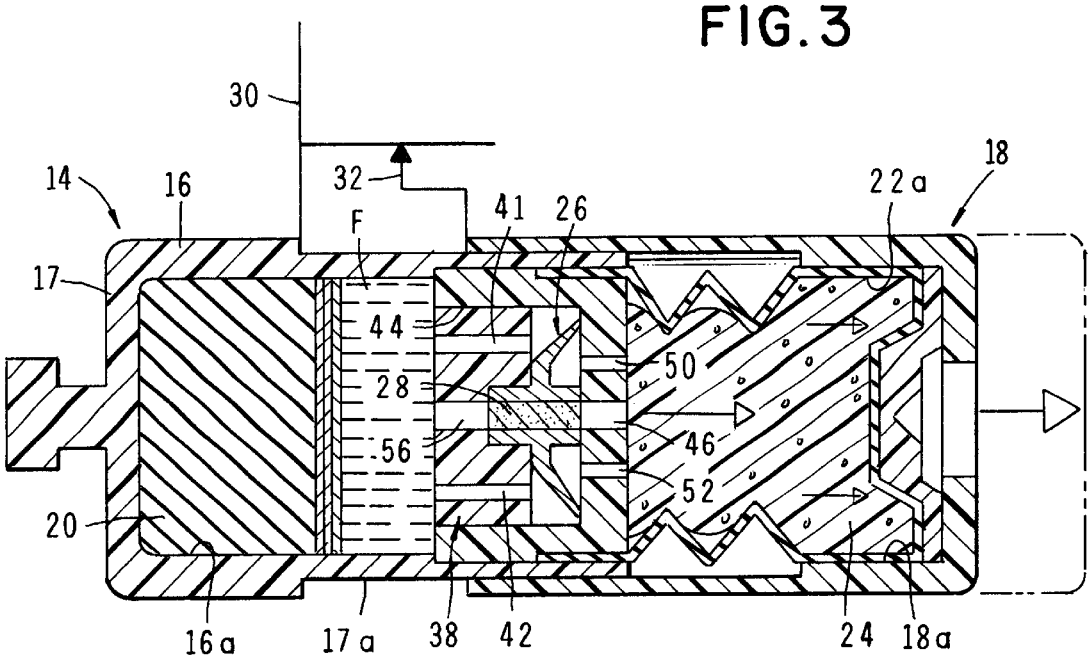
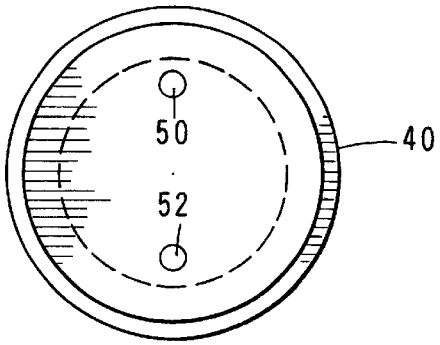
FIG.5
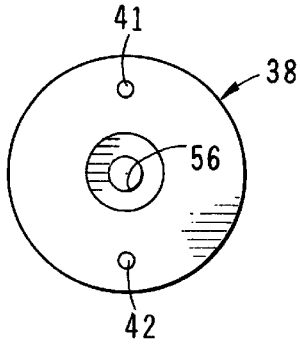
FIG.7

TIMING DEVICE

BACKGROUND OF THE INVENTION

1. Field of the Invention

The present invention relates generally to timing devices. More particularly, the invention concerns a novel fluid operated timing device in which the timing interval is determined by the rate at which the fluid flow through a precisely configured rate control frit upon being forced through the frit by an energy source in the form of a compressible elastomeric member.

2. Discussion of the Prior Art

Numerous types of mechanical, electrical and chemical timing devices have been suggested in the past. These devices have been used in countless systems which require means for establishing a period of time between the occurrence of two events. For example, timing devices are frequently used to switch relay contacts, to open and close fluid control valves, and to control the frequency of delivery of medicaments to a patient.

Perhaps the most commonly used prior art timing devices are electrical and electronic timers. However, such timers are often quite complex, expensive to manufacture and maintain and, of course, require an electrical power supply. An alternative to the electronic timer is the fluid operated timer which typically uses a control fluid such as a liquid or a gas as the timing medium. Often the fluid-operated timer is mechanically coupled with a valve in such a way that, when a preselected period of time elapses, the timer causes the valve to either open or close, thereby regulating flow of fluid.

A common type of fluid operated timer is the so-called dash pot type of delayed actuator. This type of mechanism typically includes a piston disposed within a fluid filled cylinder. As the piston is moved through the cylinder, fluid is forced through a circumferential gap between the piston and the cylinder wall so that the piston gradually changes from a first state to a second state. Another type of frequently used mechanism is the rotary plate delayed actuator. This type of actuator is often used to slow the motion of cassette tape machine doors and record player armatures. Typically these devices employ a pair of parallel plates that are separated by a layer of viscous fluid. Torque is applied to one of the plates while the other is held fixed and the viscous drag of the fluid slows the motion to the movable plate.

Exemplary of prior art mechanical timers are those described in U.S. Pat. No. 3,353,412 issued to Humphrey. The Humphrey apparatus functions to effect sequential triggering of a desired mechanism in accordance with a predetermined schedule. The timing mechanism of the apparatus comprises a drive gear and a gear train which includes a plurality of gear assemblies serially connected in driving relationship with respect to one another and an escapement assembly controls the operation of the gear train.

A typical type of dash pot timer is disclosed in U.S. Pat. No. 3,171,245 issued to Breed. The Breed device comprises a piston that travels in a cylinder at a controlled rate. The movement occurs due to a predictable fluid flow from the forward side of the piston through a predetermined annular clearance between the piston and interior cylinder walls to occupy the ever increasing volume behind the piston.

SUMMARY OF THE INVENTION

It is an object of the present invention to provide an elegantly simple, highly versatile fluid operated timing device which is easy to operate, and does not require a source of electricity.

It is another object of this invention to provide a timing device of the aforementioned character which is highly reliable in operation and can be used to operate a wide variety of fluid dispensers, valves, relays and other mechanisms.

It is another object of the invention to provide a timing device as described in the preceding paragraphs which is compact, employs a minimum number of moving parts and includes a self-contained, stored-energy source.

It is another object of the invention to provide a timing device which includes locking means that positively prevents further operation of the device until the passage of a predetermined interval of time.

It is another object of the invention to provide a timing device of the type described in the preceding paragraph which includes a manually operated control mechanism for precisely setting the interval.

It is another object of the invention to provide a timing device of the class described which includes disabling means for permanently disabling the device after use.

BRIEF DESCRIPTION OF THE DRAWINGS

FIG. 3 is a cross-sectional view similar to FIG. 2, but showing the position of the various components of the device after the actuation step.

FIG. 5 is a view taken along lines 5—5 of FIG. 4.

FIG. 7 is a view taken along lines 7—7 of FIG. 6.

DISCUSSION OF THE INVENTION

Figure 1:
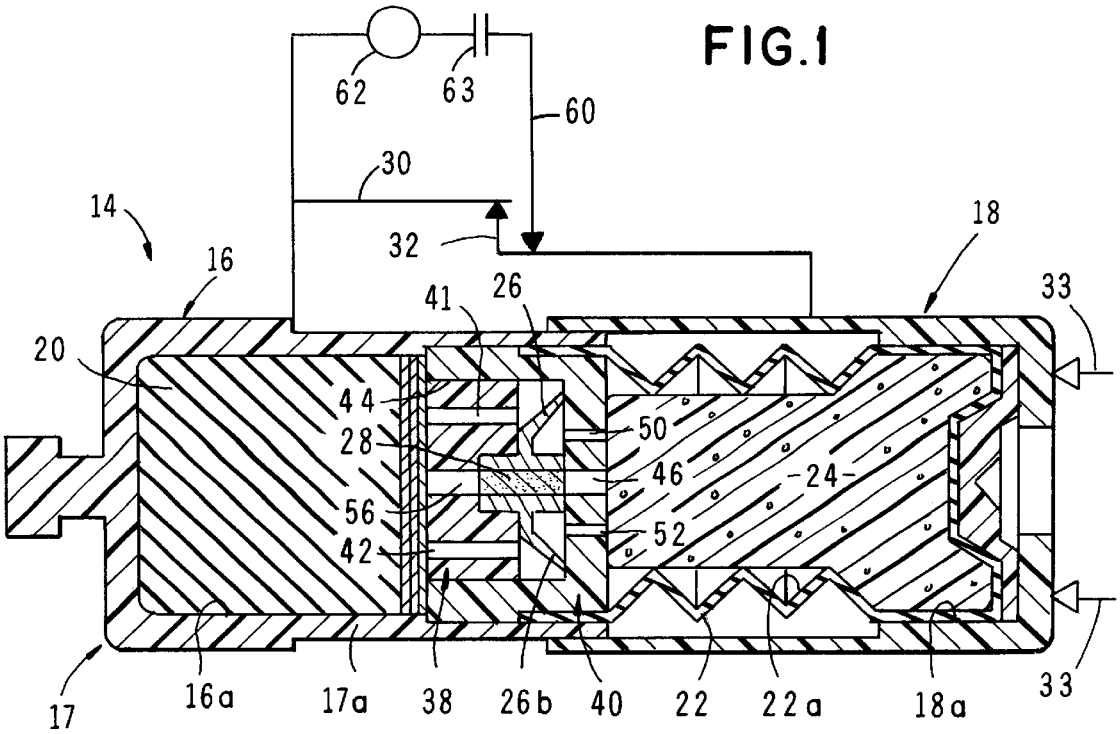
FIG. 1 is a side-elevational, cross-sectional view of one form of the timing device of the invention.

Referring to the drawings and particularly to FIGS. 1 through 7, one form of timing device of the present invention is there illustrated and generally designated by the numeral 14. The device is shown, by way of example, being used to open and close the electrical contacts of an electrical circuit used to energize and deenergize an electric motor. The timing device here comprises first and second slidably interconnected generally cylindrically shaped housings 16 and 18. Housing 16 has an end wall 17 and a skirt-like cylindrically shaped wall 17*a* which defines an internal chamber 16*a*. Disposed within internal chamber 16*a* is a yeildably deformable, compressible mass, shown here as an elastomeric member 20, which functions as an energy source when compressed. Disposed within an internal chamber 18*a* of housing 18 is a bellows-like member 22 which includes an internal chamber 22*a*. Disposed within chamber 22 is a fluid containing cellular mass 24 which comprises a sponge-like member that can be saturated with any suitable operating fluid such a glycerin, flourinated oil, or the like. Disposed intermediate elastomeric mass 20 and fluid containing cellular mass 24 are first and second flow control means for controlling fluid flow between chambers 16*a* and 22*a*.

Figure 4:
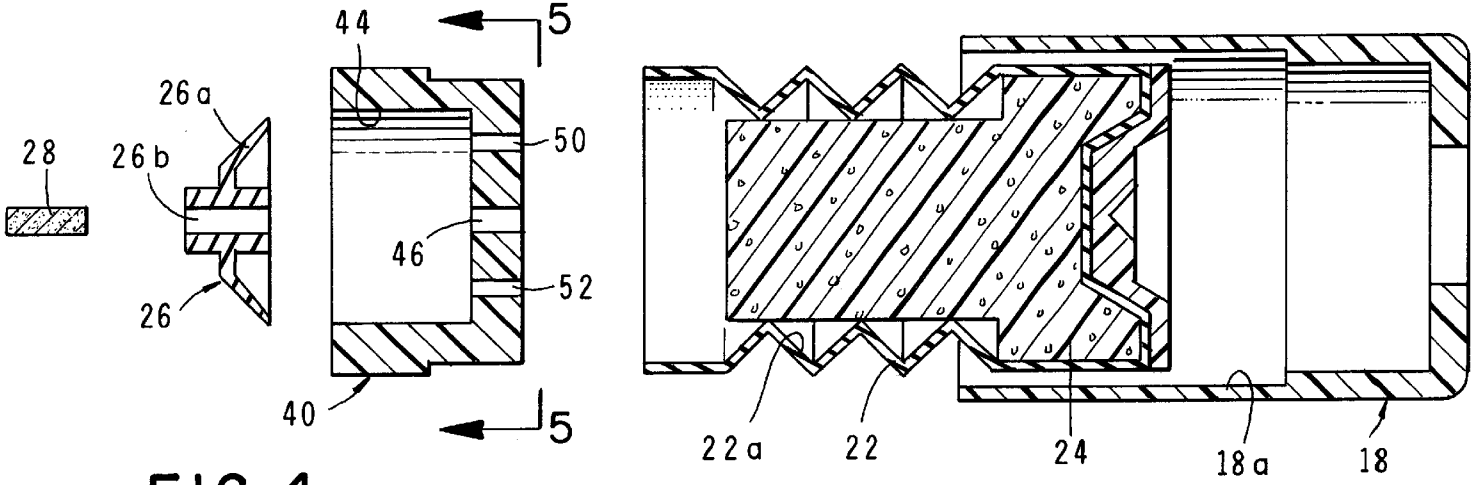
FIG. 4 is a cross-sectional exploded view of the actuator portion of the apparatus of the invention.

As best seen in FIG. 4, the first flow control means here comprises a check valve 26 which functions to permit fluid flow only in a direction toward chamber 16*a* and yieldably deformable mass 20, which is housed therein, and functions to block fluid flow in an opposite direction. The second flow control means is here provided as a porous frit 28. In a manner presently to be described, frit 28 functions to precisely control the rate of fluid flow from chamber 16*a* toward chamber 22*a* and fluid containing, sponge-like mass 24 which is housed therewithin. Connected to housing 16 is a first electrical contact 30. Connected to housing 18 is a second electrical contact 32 which is movable into engagement with contact 30 upon a sliding movement of housing 18 relative to housing 16 in the direction of the arrows 33 of FIG. 1. Contacts 30 and 32 comprise a part of the earlier mentioned electrical circuit which is controllably opened and closed by the timing device of the invention in a manner which will be more fully described in the paragraphs which follow.

In operation of the apparatus of the form of the invention shown in FIGS. 1 through 7, a force exerted by the user on the actuating means or housing 18 in the direction of the arrows 33 actuates the timer. This actuating means, which may be operated manually or by various mechanical means such as cams, levers pistons or the like, functions to controllably compress fluid containing mass 24 in a manner to expel fluid therefrom. More particularly, forces acting on housing 18 in the direction of arrows 33 will result in a telescopic movement of housing 18 relative to housing 16 in the manner shown in FIG. 2. As housing 18 moves forwardly, it will act on bellows 22 causing the bellows to collapse and, at the same time, causing controlled compression of liquid containing sponge-like mass 24. As mass 24 is compressed, the fluid contained therewithin will be forced therefrom through the first flow control means and then into chamber 16*a* of housing 16 in the direction of the arrows 35 of FIG. 2. As the fluid flows under pressure into chamber 16*a* via the first flow control means, it will compressively deform yieldably deformable member 20 in the manner shown in FIG. 2.

Figure 2:
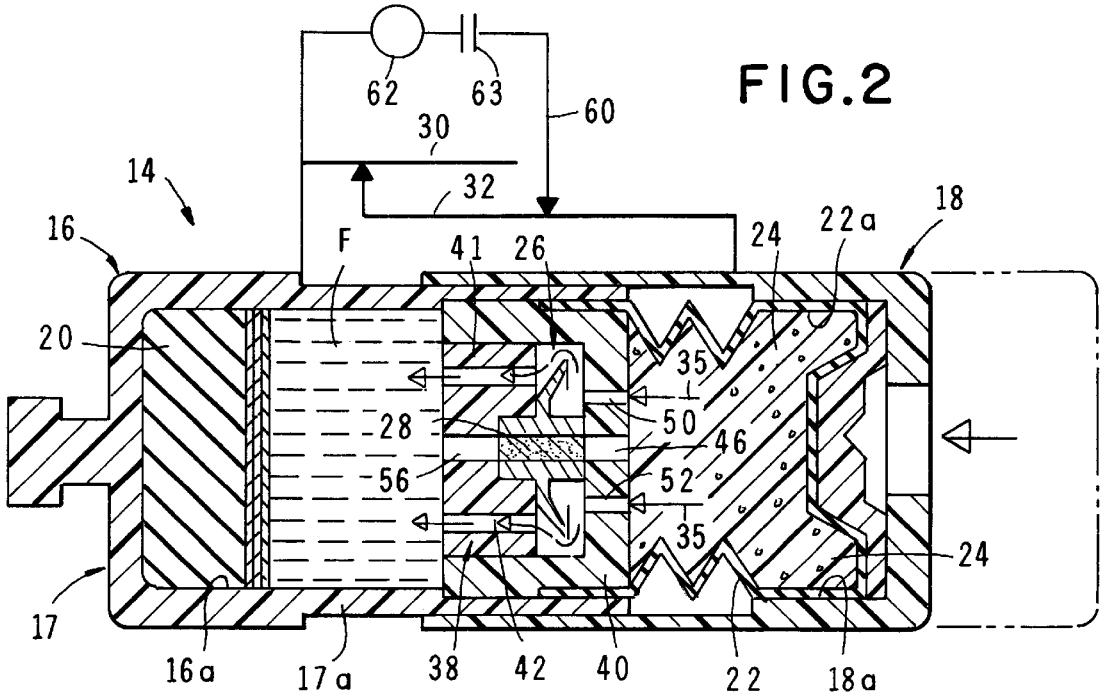
FIG. 2 is a cross-sectional view similar to FIG. 1, but showing the position of the various components of the device after the device has been actuated to start the timing sequence.
Figure 6:
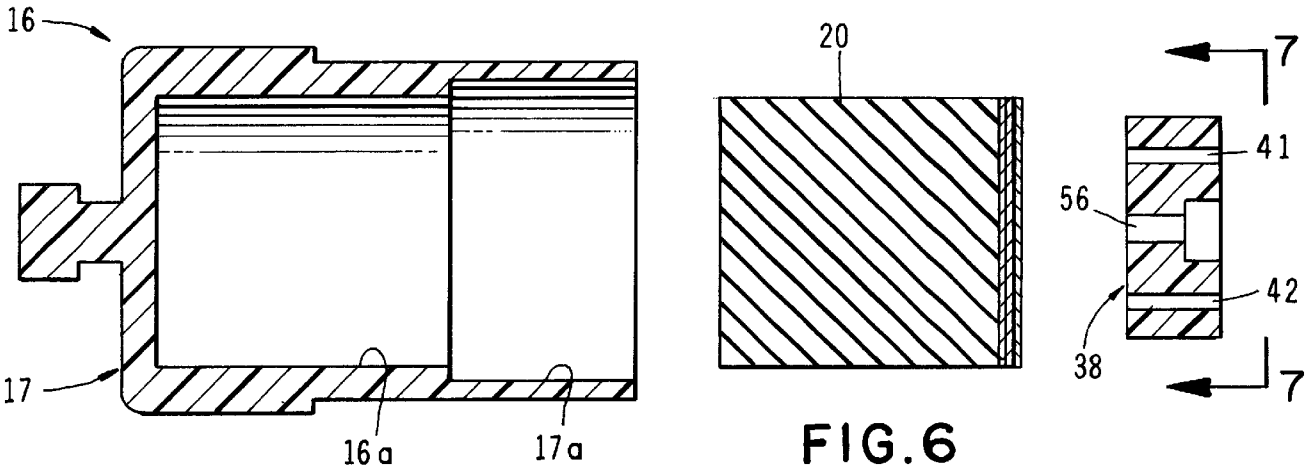
FIG. 6 is a cross-sectional, exploded view of the stored energy portion of the apparatus of the invention.

The first flow control means or check valve 26 is here provided in the form of an umbrella type check valve which is captured between first and second flow control members 38 and 40 which are disposed within housing 16 in the manner indicated in FIGS. 1, 2, and 3. As best seen in FIGS. 4 and 6 first flow control member 38 is provided with spaced-apart fluid flow passageways 41 and 42, while member 40 is provided with a central cavity 44, a central control passageway 46 and radially outwardly spaced fluid passageways 50 and 52 which are aligned with passageways 41 and 42. Umbrella check valve 26 is strategically positioned within cavity 44 and is located between members 38 and 40 so that the flexible, skirt-like portion 26*a* of the valve will deflect outwardly within cavity 44 in response to fluid flowing through passageways 50 and 52 thereby permitting the fluid to flow into fluid passageways 41 and 42 formed in member 38 and thence into chamber 16*a*. However, the construction of the umbrella-type check valve is such that the resilient skirt-like portion 26*a* of the valve will function to prevent fluid flow in the opposite direction, that is, toward chamber 22*a*.

To permit fluid flow in a direction from chamber 16*a* toward chamber 22*a*, and cellular mass 24, the rate control means, or porous frit 28 is disposed within a central passageway 26*b* formed in the umbrella valve 26 (FIG. 4). Central passageway 56 of member 38 communicates with central passageway 46 of member 40 via frit 28 so that fluid can flow from chamber 16*a* toward chamber 22*a* and cellular mass 24 only via the second flow control means or porous frit 28.

In operation, when the actuating member, or housing 18, is pushed forwardly relative to housing 16, cellular mass 24 will be compressed causing the fluid contained therein to flow through passageways 50 and 52, past check valve 26 and into chamber 16*a* via passageways 41 and 42. Fluid flowing into chamber 16*a* under pressure will compress elastomeric member 20 in the manner shown in FIG. 2 causing the buildup of internal stresses which will cause member 20 to tend to return to its original starting configuration. As best seen in FIGS. 1 and 2, as housing 18 moves forwardly, contact 32 will engage contact 30 closing circuit 60 and starting motor 62 which is powered by battery 63.

Following actuation of the device in the manner just described, elastomeric member 20 will begin to return to its starting configuration, and in so doing will act on the fluid "F" causing it to flow through porous frit 28 and toward chamber 22*a* where it will be absorbed by cellular mass 24. As mass 24 expands, it will act on housing 18 causing it to return toward its starting position. The time required for housing and contact 32 to return to their starting position is, of course, a function of the time required for the fluid "F" to flow from chamber 16*a* to chamber 22*a* which, in turn, is a function of the impedance to fluid flow offered by porous frit 28 and the ability of elastomeric member 20 to return to its uncompressed state. It is apparent that upon housing 18 returning to its starting position, contact 32 will also return to its starting position, shown in FIG. 1, thereby interrupting the circuit and deenergizing motor 60. With the construction just described, the interval of time during which the motor will remain energized can be precisely determined by the selection of a porous frit of known impedance and by selecting an elastomeric member 20 of known elasticity.

Turning next to FIGS. 8 through 12, an alternate form of timer device of the present invention is there illustrated and generally designated by the numeral 64. This latter form of the invention is similar in some respects to that shown in FIGS. 1 through 7 and like numerals are used in FIGS. 8 through 12 to identify like components. The timing device of this latest form of the invention is shown being used in connection with a conventional valving mechanism to control the flow of fluid between a fluid source and a fluid outlet.

Figure 8:
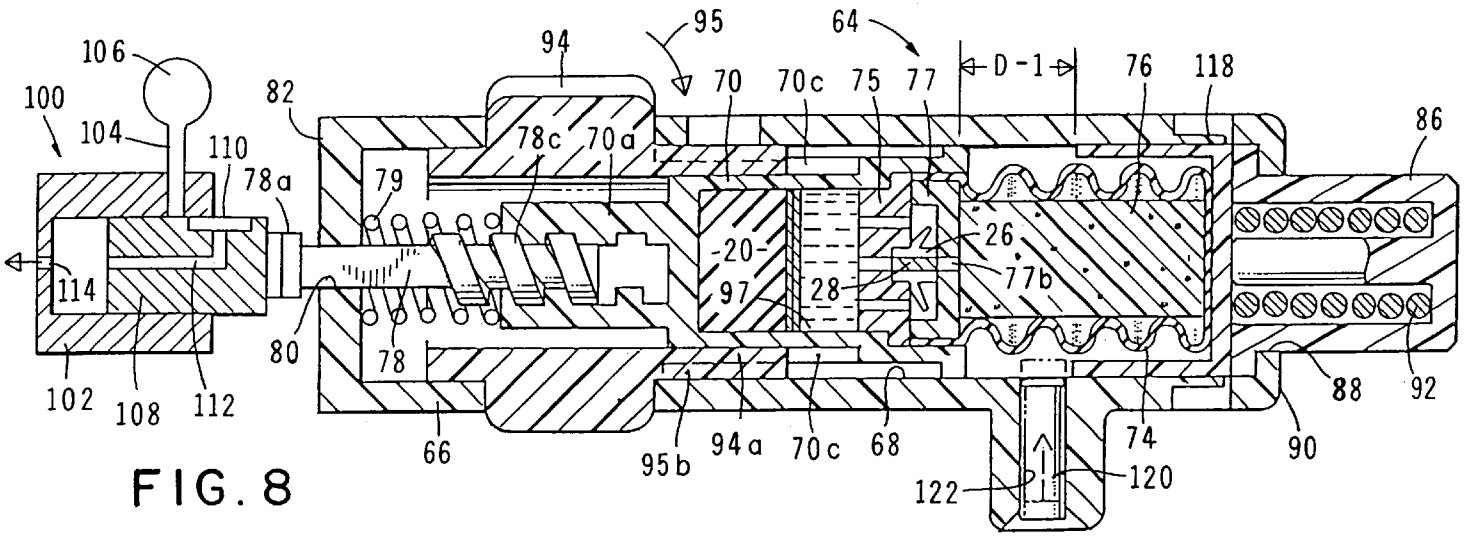
FIG. 8 is a side-elevational, cross-sectional view of an alternate form of the apparatus of the invention which includes an interval adjustment means and a device disabling the means.

As best seen in FIG. 8, the device here comprises a hollow housing 66 having an internal chamber 68. Disposed within chamber 68 is a first support member 70 which houses a yieldably deformable elastomeric member 20, which, as in the earlier described embodiment of the invention, functions as an energy source upon being compressed. Also disposed within internal chamber 68 is a second cup-like support member 72 which houses a collapsible bellows 74 and a cellular mass 76 which is of similar construction and operation to cellular mass 24. More particularly, cellular mass 76 comprises a fluid containing sponge-like structure which can be saturated with any suitable operating fluid such as glycerin or flourinated oil. Disposed intermediate elastomeric member 20 and cellular mass 76 are first and second flow control means for controlling fluid flow between the two components. These flow control means are of the general character previously described. As before, and a check valve 26 functions to permit fluid flow only in a direction toward elastomeric member 20 and functions to block fluid flow in an opposite direction. The second flow control means of this latest form of the invention also comprises a porous frit 28 which functions to precisely control the rate of fluid flow toward the fluid containing, sponge-like mass 76 which is housed within second support member 72.

Figure 11:
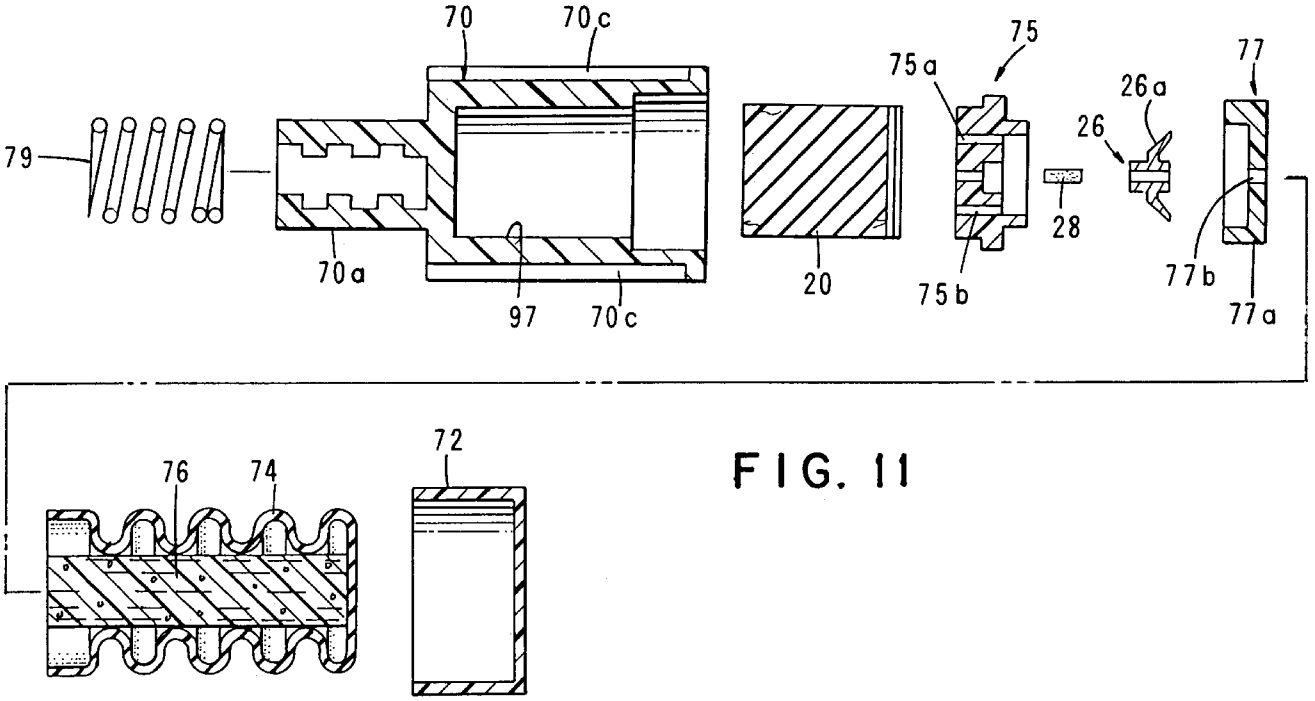
FIG. 11 is a side elevational, cross-sectional, exploded view of the actuator means and the stored energy means of the form of the invention shown in FIG. 10.

As best seen in FIGS. 8 and 11, a first flow control member 75 which is disposed proximate elastomeric member 20 provided with spaced-apart fluid flow passageways 75*a* and 75*b*. A second flow control member 77 is provided with a central cavity 77*a* and a central control passageway 77*b*. Umbrella check valve 26 is strategically positioned within cavity 77*a* and is located between members 75 and 77 so that the flexible, skirt-like portion 26*a* of the valve will deflect outwardly within cavity 77*a* in response to fluid flowing through passageway 77*b* thereby permitting the fluid to flow into fluid passageways 75*a* and 75*b* formed in member 75 and thence toward elastomeric member 20.

Figure 12:
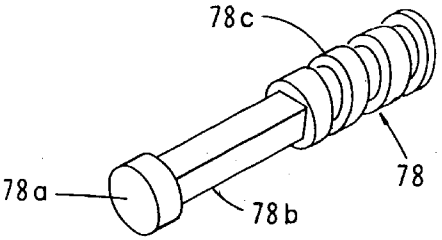
FIG. 12 is a generally perspective view of the thrustor member of the apparatus of the invention shown in FIG. 10.

Support member 70 includes an internally threaded collar-like portion 70*a* to which a thrustor or operating member 78 is threadably connected. Member 78 extends through a square bore 80 provided in a forward closure wall 82 of housing 66 and includes a pusher head 78*a*. In a manner presently to be described, thruster member 78 is slidably movable from the first position shown in FIG. 8 to the second position shown in FIG. 9. However, as seen in FIG. 12, the shank portion 78*b* of member 78 is square in cross section so that the member will not rotate relative to the square hole 80 provided in end walls 82.

Provided proximate the opposite end of housing 66 from wall 82 is an actuating means which here comprises a generally cylindrically shaped, hollow actuating member 86 which is telescopically receivable within an opening 88 provided in the rear wall 90 of housing 66. Disposed within member 86 is a first biasing means, shown here as a coil spring 92, which yieldably resists inward movement of member 86.

Rotatably carried by housing 66 is a control knob 94 which is interconnected with member 70 by means of splines 94*b* formed on a collar-like portion 94*a* of control knob 94. Splines 94*b* are receivable within mating grooves 70*c* formed in the enlarged diameter portion of support member 70 so that rotation of knob 94 will cause member 70 to rotate and move along threaded shank 78*c* either to the right or left from the position shown in FIG. 8. As indicated in FIG. 8, rotation of knob 94 will vary distance "D-1" either increasing or decreasing it depending upon the direction of rotation of the knob.

It is apparent that the degree of compression of cellular mass 76 is controlled by the position of member 70 on the threaded shank portion 78*c* of member 78. As described in the preceding paragraph, this position is, in turn, controlled by the extent of rotation of control knob 94 relative to housing 66. In the position of the components as shown in FIG. 8, knob 94 has been rotated in the direction of arrow 95 to cause member 70 to move to the right partially compressing fluid containing cellular mass 76 and causing the fluid contained therewithin to flow into a chamber 97 formed by the interior surface of support member 70. This fluid flow will compress member 20 to the degree shown in FIG. 8. Upon pressing the actuating member 86 inwardly, in the manner shown in FIG. 9, support member 72 will be moved a distance D-1 compressing fluid containing cellular mass 76 and causing fluid to flow in to chamber 97. The greater the distance D-1, the greater will be the compression of mass 76 and the volume of fluid that is displaced. Similarly, the greater the volume of fluid in chamber 97, the greater will be the time required for the fluid to flow through frit 28 as the fluid is forced back toward cellular mass 76 due to the urging of elastomeric member 20 and the longer will be the time for support member 72 to return to its starting position. Conversely, the greater the degree of compression of mass 76 due to the rotation of control member 94, the lesser will be the distance D-1 allowed for travel of support member 72 and the shorter will be the time required for support member 72 to return to its starting position.

As previously mentioned and, by way of example, the timing device of this latest form of the invention is shown in operable association with a valving mechanism generally designated in the drawings by the numeral 100. Valving mechanism 100 includes a hollow body portion 102 having a fluid inlet 104 which is connected to a source of fluid under pressure 106. Telescopically movable within body portion 102 is a piston-like member 108 which is here acted upon by the thruster 78 of the timing device. Member 108 includes a fluid receiving chamber 110 which communicates with a longitudinally extending fluid passageway 112. Fluid passageway 112, in turn, communicates with the valve assembly outlet 114 which may be interconnected with any remotely located fluid delivery site.

Figure 9:
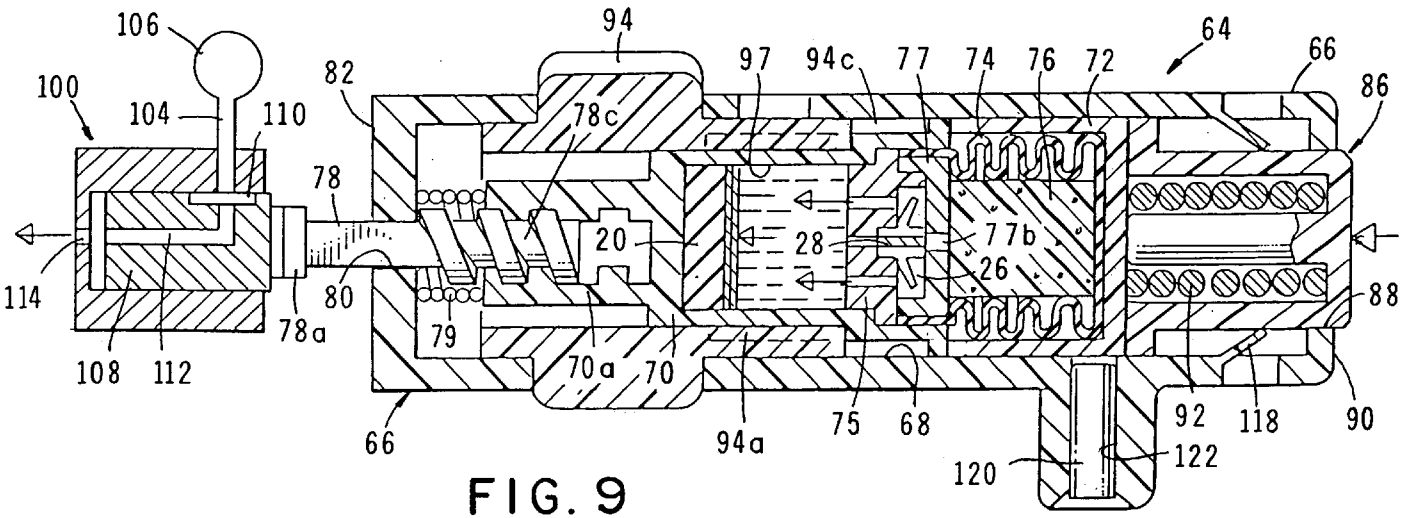
FIG. 9 is a side-elevational, cross-sectional view similar to FIG. 8, but illustrating the actuation step and showing the actuating member having been telescopically inserted into the device housing.

As indicated in FIG. 8, in the initial starting position, after knob 94 has been suitably adjusted to set the distances "D-1", head portion 78*a* of threaded member 78 is in contact with piston-like plunger 108. In this starting configuration, it is to be noted that inlet passageway 104 is blocked by member 108 so that fluid cannot flow toward fluid outlet port 114. However, as shown in FIG. 9, upon member 86 being pushed inwardly of the housing to a position wherein the forward collar-like portion of housing 72 engages the rearmost edge of housing 70 which causes the entire internally disposed control assemblage of the unit to move to the left as viewed in FIG. 9. As the control assemblage moves to the left as viewed in FIG. 10, member 78 will also move to the left and will act upon plunger 108 moving it to the left. This, in turn, will move inlet passageway 104 into fluid communication with receiving chamber 110. With the component parts of the valving assembly in this position, fluid can freely flow from fluid source 106, through passageway 104, into chamber 110, and outwardly of the device via passageway 112 and outlet port 114. When the component parts of the timer device return to their initial starting position in a manner presently to be described, member 78 will, in turn, return to its starting position and carry with it plunger 108 so that plunger 108 will once again block inlet passageway 104 and prevent further fluid flow through the valving assembly. It is to be understood that various types of valving configurations could be used in conjunction with the timing device of the apparatus of the invention and that the valving mechanism could be associated with a very large number of remotely located fluid actuated or fluid driven devices. Accordingly, assemblage 100 is depicted in the drawings only by way of example and is not intended as a limitation on the types of valving assemblies that could be operably associated with the timing device of the invention and operated by movement of member 78 as a result of actuating the device by pushing start button or actuating member 86 inwardly of housing 66.

As discussed in the preceding paragraphs, in order to actuate the timing device of the invention, member 86 must be pushed inwardly of housing 66 in the manner shown in FIG. 9. As member 86 is pushed inwardly manually by an operator, or mechanically by a cam, lever, piston or the like, thruster member 78 will also move forwardly, or to the left, in the manner shown in FIG. 9 and will act on the valving mechanism which is of the construction described in the preceding paragraph. Disposed within hollow housing 66 is a housing biasing means, here shown as a coiled return spring 79. Coiled spring 79 yieldably resists movement of member 70 to the left and also functions to urge the control assemblage toward its starting position when actuating member 86 is released.

Figure 10:
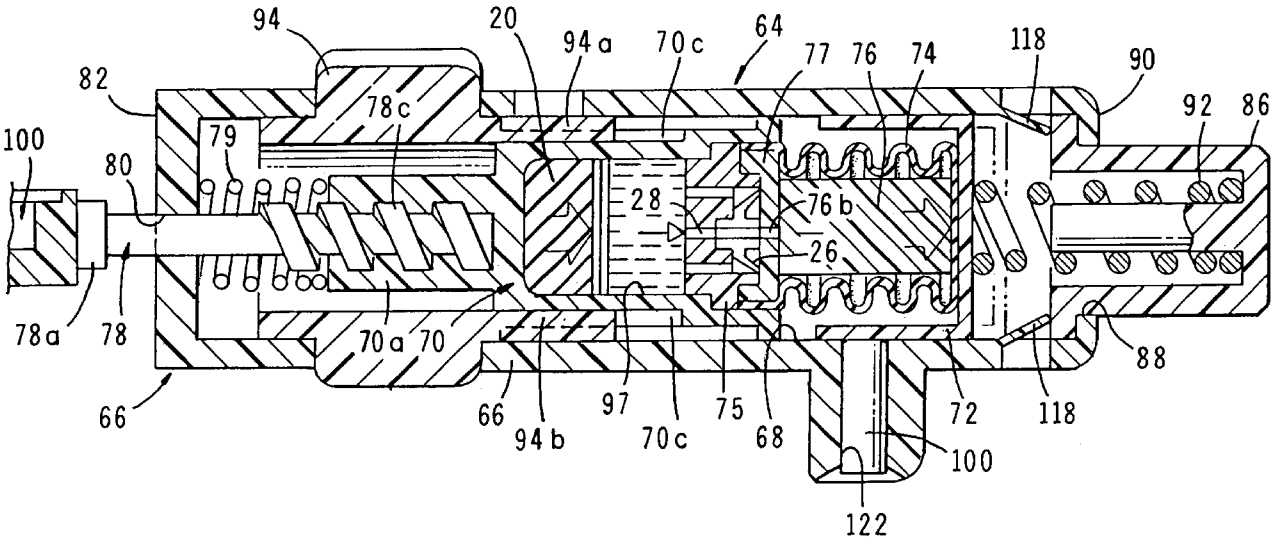
FIG. 10 is a side-elevational, cross-sectional view similar to FIG. 9, but showing the actuating member returned to an extended, locked position relative to the housing.
Figure 10A:
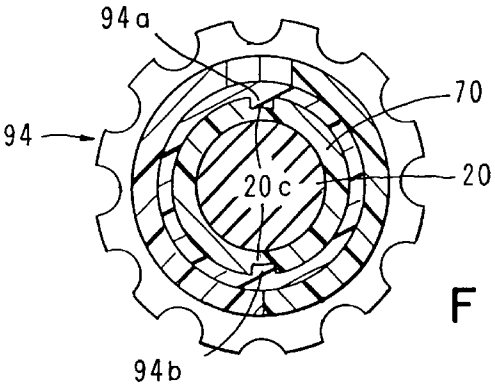
FIG. 10A is a cross-sectional view taken along lines 10A—10A of FIG. 10.

When the actuating member 86 is depressed, spring 92 which is housed therein will be compressed so that, upon release of member 86, spring 92 will tend to rapidly return member 86 to the position shown in FIG. 10. In this starting position, member 86 will be uniquely locked against further inward movement by resilient locking tabs 118 which are provided on housing 66 and which here comprise a part of the important delay or lock-out means of this latest form of the invention which prevents further actuation of the device for a predetermined interval of time.

Referring particularly to FIG. 9, the delay means of the invention functions as follows: While the actuating member 86 will immediately return to its starting position upon its release due to the action of spring 92, support member 72 does not do so. Rather, as previously mentioned, the return of member 72 to its starting position, is uniquely a function of the rate of fluid flow through rate control frit 28.

As the fluid within chamber 97 returns to mass 76 due to the urging of elastomeric member 20 and spring 79, mass 76 will expand toward its starting position, and will urge support member 72 rearwardly into camming engagement with locking tabs 118 moving them once again into the unlocked position shown in FIG. 8. The time required for member 72 to return to its starting position, of course, equates to the delay time between sequential delivery operations of the timing device. This interval of time is dependent on the magnitude of distance "D-1" as set by knob 94, by the porosity of frit 28 and by the elasticity characteristics of elastomeric member 20. By appropriately controlling these variables, a wide range of precise delay times can be achieved to control the interval of time that must pass before the time can once again be actuated to operate the valving assembly. By way of example, if the time device is being used to control a valving assembly which is regulating the administration of medicaments to a patient, the positive regulation of the intervals of time between each sequential administration of medicament doses can be critical.

This latest form of the invention also includes disabling means for disabling the apparatus. This disabling means here comprises a disabling button 120 which is telescopically movable within a bore 122 formed in housing 66. When button 122 is pushed inwardly as shown by the phantom lines in FIG. 8, the inboard end thereof will block forward movement of support member 72 thereby preventing inward movement of actuating member 86.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A timing device comprising:

(a) A first member defining a first chamber;

(b) a yeildable deformable mass disposed within said first chamber of said first member;

(c) a second member defining a second chamber in fluid communication with said first chamber;

(d) a cellular, fluid containing mass disposed within said second chamber of said second member;

(e) a first flow control means disposed intermediate said first and second members for controlling fluid flow toward said first chamber;

(f) a second flow control means disposed between said first and second members for controlling the rate of fluid flow in a direction from said first chamber toward said second chamber; and (g) means for compressing said fluid containing mass to expel the fluid therefrom.

2. A timing device as defined in claim 1 in which said first flow control means comprises a check valve.

3. A timing device as defined in the claim 1 in which said second flow control means comprises a porous flow control frit.

4. A device as defined in claim 1 in which said first member comprises a housing having an end wall and a generally cylindrically shaped, skirt-like wall connected to said end wall, said first chamber being disposed within said cylindrically shaped skirt-like wall, said timing device further including:

(a) a first flow control element disposed within said cylindrical wall; and (b) a second flow control element disposed within said cylindrical wall, said first flow control means being disposed intermediate said first and second flow control elements.

5. A device as defined in claim 1 in which said first flow control means comprises a check valve having a central fluid passageway, said second flow control means being disposed within said central fluid passageway of said check valve.

6. A timing device comprising:

(a) a first housing having a chamber;

(b) a yieldably deformable mass disposed within said chamber of said first housing;

(c) a second housing movable relative to said first housing between first and second positions, said second housing having a chamber in fluid communication with said first chamber of said first housing;

(d) a fluid containing mass disposed within said chamber of said second housing;

(e) a first flow control means disposed between said yieldably deformable mass and said fluid containing mass for controlling fluid flow therebetween in a first direction;

(f) a second flow control means disposed between said yieldably deformable mass and said fluid containing mass for controlling fluid flow therebetween in a second direction; and (g) actuating means for moving said first and second housings relative to each other.

7. A timing device as defined in claim 6 in which said first flow control means comprises a check valve.

8. A timing device as defined in claim 6 in which said second flow control means comprises a porous flow control frit.

9. A timing device as defined in claim 6 further including a first electrical contact connected to said first housing and a second electrical contact connected to said second housing.

10. A timing device as defined in claim 6 further including a hollow housing within which said first and second housings are telescopically movable by said actuating means.

11. A timing device as defined in claim 10 further including housing biasing means disposed within said hollow housing for yieldably resisting movement of said first and second housings by said actuating means.

12. A timing device as defined in claim 10 further including a thruster member connected to said first housing for movement therewith.

13. A timing device as defined in claim 12 in which said thruster member is threadably connected to said first housing.

14. A timing device as defined in claim 13 further including a control knob rotatably carried by said hollow housing, said knob being connected to said first housing for imparting rotation thereto relative to said thruster member.

15. A timing device as defined in claim 14 further including valve means operably associated with said thruster member, said valve means including a valve housing and a piston movable within said valve housing by said thruster member.

16. A timing device as defined in claim 14 further including lock-out means carried by said hollow housing which prevent operation of said actuating means for an interval of time.

* * * * *